US010157601B1

(12) United States Patent
Runge

(10) Patent No.: US 10,157,601 B1
(45) Date of Patent: Dec. 18, 2018

(54) REMOVABLE STRAP BUTTON AND CONNECTOR FOR MUSICAL INSTRUMENTS

(71) Applicant: Brett Runge, San Clemente, CA (US)

(72) Inventor: Brett Runge, San Clemente, CA (US)

( * ) Notice: Subject to any disclaimer, the term of this patent is extended or adjusted under 35 U.S.C. 154(b) by 0 days.

(21) Appl. No.: 15/861,532

(22) Filed: Jan. 3, 2018

(51) Int. Cl.
*G10G 5/00* (2006.01)
*G10G 7/00* (2006.01)

(52) U.S. Cl.
CPC ..... *G10G 5/005* (2013.01); *G10G 7/00* (2013.01)

(58) Field of Classification Search
CPC ..... G10G 5/005; G10G 7/00
See application file for complete search history.

(56) References Cited

U.S. PATENT DOCUMENTS

2009/0056522 A1* 3/2009 Mercer ..... G10G 5/005 84/327
2012/0279375 A1* 11/2012 Page ..... G10D 1/08 84/327
2016/0027417 A1* 1/2016 Koster ..... A44B 11/2584 84/327

* cited by examiner

*Primary Examiner* — Kimberly Lockett
(74) *Attorney, Agent, or Firm* — Stetina Brunda Garred and Brucker

(57) ABSTRACT

A strap button and connector for connecting one end of a strap to a musical instrument or other body consists of a connector fixed to the instrument and a removable strap button to hold a strap securely. The connector has a large opening or mouth and is designed so that the strap button and the connector be easily engaged or disengaged. When the threaded neck of strap button is received into threaded connector cavity the strap button is easily hand screwed together and the additional aid of a rubber washer placed between strap button neck and connector head or lip keeps the two parts from disengaging. The strap at this point is secure from coming off the strap button and the strap still has movability between player and instrument.

20 Claims, 2 Drawing Sheets

REMOVABLE STRAP BUTTON AND CONNECTOR FOR MUSICAL INSTRUMENTS

BACKGROUND OF THE INVENTION

The present invention relates to the strap button and connector for the strap of the musical instrument or other body, and deals more particularly with such a strap button and connector consisting of cooperating parts adapted to be fixed to the body and to securely hold the strap, respectively.

In the case of a number of musical instruments, such as guitars, string basses, banjos, mandolins and ukuleles it is common practice to attach to the instrument to a strap which passes around the neck or over the shoulder of the player to aid in holding the instrument in a playing position either standing or sitting. Even when a strap is used, the player generally wants a certain degree of freedom in moving the instrument relative to the body and, for this reason, it is generally preferred that the strap be connected to the instrument in such a way as to allow for movement between the strap and the instrument. It is also usually preferred that the strap be capable of being easily and quickly engaged and disengaged from the instrument so as to facilitate the performer's taking up and putting down of the instrument as well as switching from one instrument to another.

Various different strap buttons or end pins and strap locks have been proposed in the past for engaging and disengaging straps to musical instruments, but all of these have been subject to many disadvantages. The general object of this invention is, therefore, to provide a much improved yet simplified, removable strap button and connector.

In keeping with the general object, a more particular object of the invention is to provide a strap button having, in its engaged condition, a very positive type of lock which prevents disengagement of the strap button and connector.

Another object of the invention is to provide a strap button and connector which may be used with all types of musical instruments requiring straps and which may also be used for attaching straps to other types of bodies wherever a releasable connection between a strap and body is required.

Another object of the invention is to provide a connection of the foregoing character wherein the larger strap button head prevents the strap from coming off during normal playing of the instrument or non playing of the instrument.

A further object of the invention is to provide a connection of the foregoing character wherein the connector has a wide opening or mouth for receiving the strap button and for thereby easing the preciseness of the movement required to bring the two parts into an engaged relationship.

A still further object of the invention is to provide a strap button and connector of the type mentioned which provides for a quick and smooth engagement or disengagement of a strap to and from a musical instrument or other body, and which is very reliable.

Other objects and advantages of the invention will be apparent from the following description of the preferred embodiment thereof and from the accompanying drawings.

BRIEF SUMMARY OF THE INVENTION

This invention resides in a strap button and connector for releasably connecting one end of a strap to a musical instrument or other body with such connection including a connector adapted to be fixed to the instrument or other body and a strap button to hold a strap. The strap button has a large diameter head which prevents the strap from coming off and a smaller diameter neck below the head which fits all strap button holes and allows for movability between player and instrument while the strap button and connector are engaged. The connector is fixed to the body of the instrument internally for the purpose of strength and has lip with a large opening or mouth and is designed so that the strap button and the connector be easily engaged or disengaged. For a very positive lock between the strap button and connector the two parts are threaded which allows them to be tightly engaged. Also a rubber washer is set-in at the bottom of the strap button neck just below the head, once the strap button and connector are fully engaged the rubber washer is pressed tightly between the head or lip of the connector and the strap button neck to prevent the two parts from disengagement.

The invention also resides in other details of the strap button and connector for achieving the objects referred to above.

DETAILED DESCRIPTION OF THE INVENTION

Figure 1:
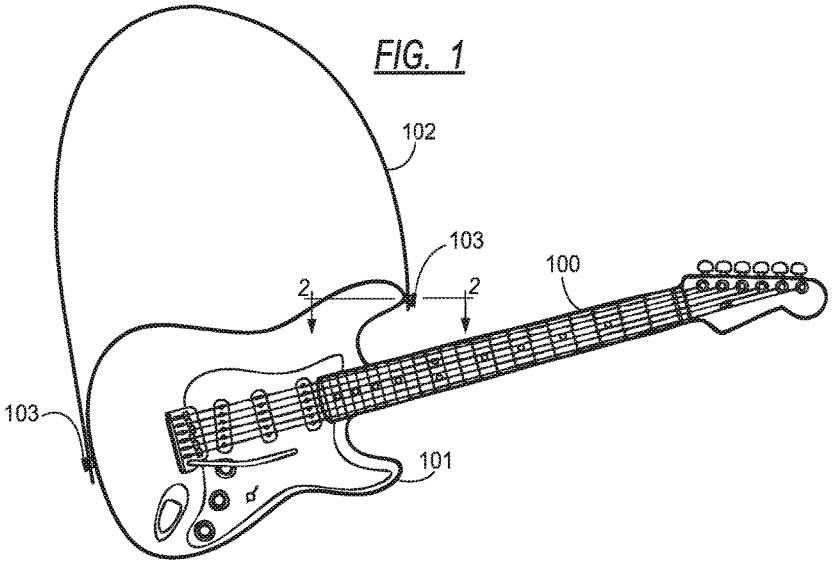
FIG. 1 is a plan view of a guitar having a strap connected to it by two identical strap buttons and connectors each embodying the present invention.
Figure 6:
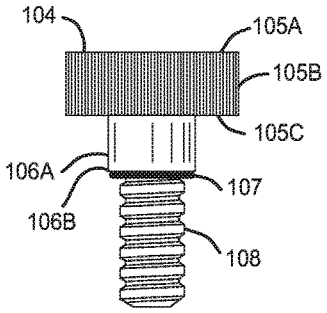
FIG. 6 is a plan view of the strap button of FIG. 2, this view being taken with the connector disengaged and strap removed.

An application of a strap button and connector embodying the present invention is shown in FIG. 1 wherein a guitar 100 with a body 101 is fitted with a strap 102 which is connected to the guitar body 101 at each of its ends by two strap buttons and connectors 103. These strap buttons and connectors 103 allow the strap 102 to be quickly and easily engaged or disengaged, one or both ends of the strap 102 from or to the body 101. The two strap buttons and connectors 103 are identical to one another and, for the purpose of discussion, the strap button and connector 103 shown in more detail in FIGS. 2 to 7 is taken to be the right-hand strap button and connector 103 of FIG. 1.

Figure 2:
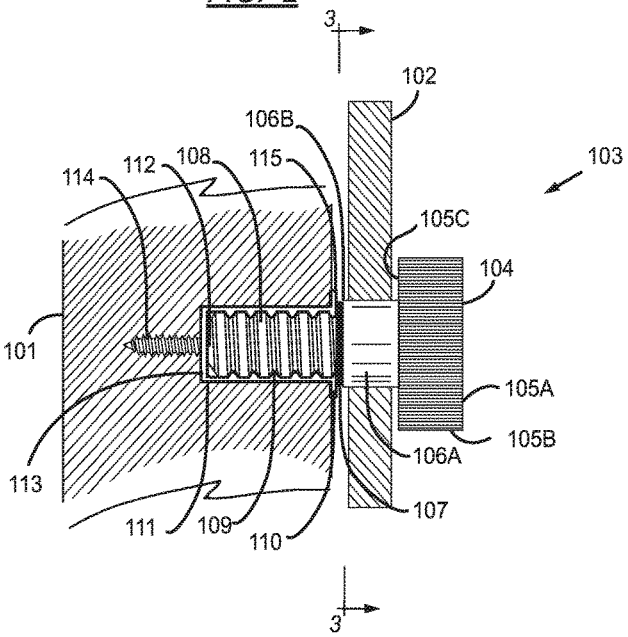
FIG. 2 is a longitudinal sectional view taken through the right-hand strap button and connector of FIG. 1 and on the line 2-2 of FIG. 1 and FIG. 3.
Figure 7:
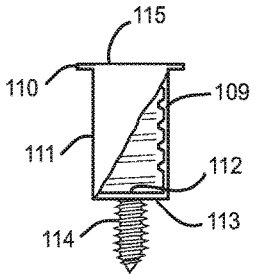
FIG. 7 is a sectional plan view taken of the right-hand connector of FIG. 2, this view being taken with the connector removed from body and previewing both the external and internal threaded wall.
Figure 3:
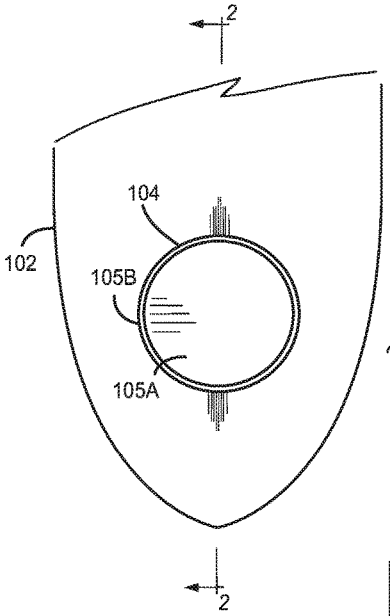
FIG. 3 is a sectional view taken on the line 3-3 of FIG. 2.
Figure 4:
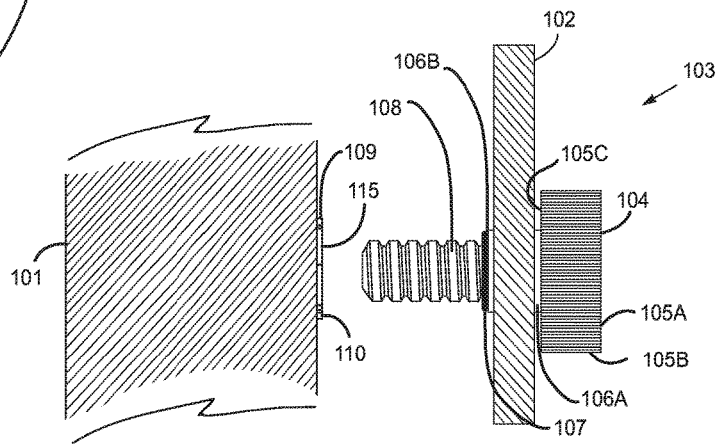
FIG. 4 is an enlarged elevational view of the right-hand strap button going through strap hole and connector of FIG. 1 but with the two parts being shown in their disassembled condition.
Figure 5:
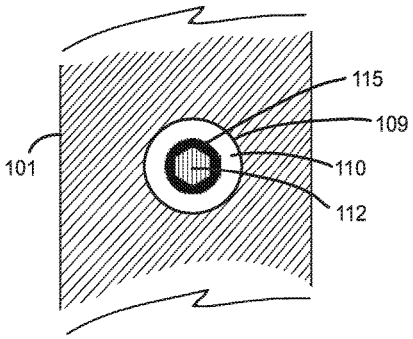
FIG. 5 is an enlarged elevational face view of the right-hand connector head or lip, opening and internal base showing hex key fitting.

Referring to FIGS. 2 to 7, the strap button and connector 103 consists basically of two parts, these being a body mounted part or connector 109 and a strap mounted part or strap button 104. The connector 109, as best shown in FIGS. 2, 4, 5 and 7, is a unitary member having a generally cylindrical head or lip portion 110 at its upper or outer end with a slightly smaller diameter mouth or opening 115 which is followed immediately by an internally threaded neck portion 111 which has a slightly smaller diameter than the head or lip portion 110. Centered at the outer base 113 of the neck 111 is a small diameter screw 114 which engages the instrument body 101. Centered at the internal base of connector 109 is a hex hey fitting 112 for a hex key which allows the connector 109 to be internally mounted securely to body 101 as shown in FIGS. 2, 4 and 5.

The strap button 104 as best shown in FIGS. 2, 3, 4 and 6, is a unitary member having a generally cylindrical larger head portion 105A at its upper or outer end which is followed immediately by a vertical textured sidewall 105B and a base 105C having the same diameter of head portion 105A. Centered at the base 105C is a smaller diameter neck portion 106A and at base 106B of neck 106A is a set-in rubber washer 107 having the same diameter as connector 109 head or lip portion 110. Centered at the base 106B between set-in washer 107 and sidewall of neck 106A is a smaller diameter threaded neck 108. The threads of neck 108 match to the connector 109 internal threaded sidewall 111 which allows the two parts 104 and 109 to engage and disengage smoothly, as shown in FIG. 2 engaged and FIG. 4 disengaged.

Referring to FIG. 4, when these two parts 104 and 109 are fully engaged the set-in rubber washer 107 located at base 106E of strap button 104 presses up against connector 109 head or lip portion 110 and prevents these two parts 104 and 109 from moving or coming disengaged, as shown in FIG. 2.

Referring to FIG. 2 and FIG. 4, the width and diameter of neck 106A of strap button 104 fits all strap 102 holes and when engaged with connector 109 the width of neck 106A allows the strap 102 to pivot freely relative to the body 101.

Referring to FIG. 3, is a sectional view taken on the line 3-3 of FIG. 2, the strap button 104 has passed through the strap 102 hole also showing the larger diameter strap button head 105A-C prevents the strap 102 from coming off the strap button 104. The strap 102, strap button 104 and connector 109 are then engaged, as shown in FIG. 2. Also, the head 105A of strap button 104 and the head or lip 110 of connector 109 can take on a variety of decorative forms, but need not include any decorative elements at all, as shown in FIG. 3, head 105A and FIG. 5, head or lip 110. The strap button 104 and connector 109 can also take on a variety of decorative colored finishes, but need not include any colored finishes at all and left in the raw stage.

I claim:

1. A connector assembly for connecting a strap to a musical instrument, the strap having a hole formed therein, the connector assembly comprising:

a male component having a head portion, a neck portion, and a shaft portion, the neck portion being disposed between the head portion and the shaft portion, the shaft portion being externally threaded, the shaft portion and the neck portion being sized to be advanceable through the hole in the strap, the head portion being sized to mitigate advancement thereof through the hole in the strap; and a female component selectively engageable with the musical instrument and with the male component, the female component having:

a sidewall extending around a cavity, the sidewall being internally threaded and sized to be selectively engageable with the shaft portion of the male component such that the shaft portion is received into the cavity; and a screw coupled to the sidewall and engageable with the musical instrument to attach the female component to the musical instrument.

2. The connector assembly recited in claim 1, wherein the head portion is of a first diameter and the neck portion is of a second diameter less than the first diameter.

3. The connector assembly recited in claim 2, wherein the shaft portion is of a third diameter less than the second diameter.

4. The connector assembly recited in claim 1, wherein the female component includes a closed end and an open end, the sidewall extending between the closed end and the open end.

5. The connector assembly recited in claim 4, wherein the female component further includes a lip extending radially outward from the sidewall adjacent the open end.

6. The connector assembly recited in claim 5, further comprising a washer engageable with the neck portion and the lip.

7. The connector assembly recited in claim 6, wherein the washer is configured to mitigate disengagement between the neck portion and the lip when the washer is engaged with the neck portion and the lip.

8. The connector assembly recited in claim 7, wherein the washer is formed from rubber.

9. The connector assembly recited in claim 1, wherein the screw includes a head exposed to the cavity, the head being engageable with a tool for rotating the screw to facilitate engagement of the screw with the musical instrument.

10. The connector assembly recited in claim 9, wherein the head includes a hex key fitting.

11. A connector assembly for connecting a strap to a musical instrument, the strap having a hole formed therein, the connector assembly comprising:

a male component having a head portion, a neck portion, and a shaft portion, the neck portion being disposed between the head portion and the shaft portion, the shaft portion and the neck portion being sized to be advanceable through the hole in the strap, the head portion being sized to mitigate advancement thereof through the hole in the strap; and a female component selectively engageable with the musical instrument and with the male component, the female component having:

a neck having a base and sidewall extending from the base and around a cavity sized to receive the shaft portion of the male component to facilitate engagement between the male component and the female component; and a screw extending from the base and engageable with the musical instrument to attach the female component to the musical instrument.

12. The connector assembly recited in claim 11, wherein the head portion is of a first diameter and the neck portion is of a second diameter less than the first diameter.

13. The connector assembly recited in claim 12, wherein the shaft portion is of a third diameter less than the second diameter.

14. The connector assembly recited in claim 11, wherein the female component includes a closed end and an open end, the sidewall extending between the closed end and the open end.

15. The connector assembly recited in claim 14, wherein the female component further includes a lip extending radially outward from the sidewall adjacent the open end.

16. The connector assembly recited in claim 15, further comprising a washer engageable with the neck portion and the lip.

17. The connector assembly recited in claim 16, wherein the washer is configured to mitigate disengagement between the neck portion and the lip when the washer is engaged with the neck portion and the lip.

18. The connector assembly recited in claim 17, wherein the washer is formed from rubber.

19. The connector assembly recited in claim 11, wherein the screw includes a head exposed to the cavity, the head being engageable with a tool for rotating the screw to facilitate engagement of the screw with the musical instrument.

20. The connector assembly recited in claim 19, wherein the head includes a hex key fitting.

* * * * *